US006267028B1

(12) United States Patent
Macor

(10) Patent No.: US 6,267,028 B1
(45) Date of Patent: Jul. 31, 2001

(54) WRENCH WITH PINCH-LOCKING ENGAGING SURFACES

(75) Inventor: Richard J. Macor, Asbury, NJ (US)

(73) Assignee: Proprietary Technologies, Inc., Hunterdon County, NJ (US)

( * ) Notice: Subject to any disclaimer, the term of this patent is extended or adjusted under 35 U.S.C. 154(b) by 0 days.

(21) Appl. No.: 09/522,345

(22) Filed: Mar. 9, 2000

Related U.S. Application Data

(63) Continuation-in-part of application No. 09/208,372, filed on Dec. 9, 1998, now Pat. No. 6,082,228.

(51) Int. Cl.[7] ..... B25B 13/08
(52) U.S. Cl. ..... 81/119; 81/186
(58) Field of Search ..... 81/119, 121.1, 81/125.1, 186, 426, 424.5

(56) References Cited

U.S. PATENT DOCUMENTS

| | | |
|---|---|---|
| D. 357,618 | 4/1995 | Macor . |
| D. 412,819 | 8/1999 | Macor . |
| 4,776,244 | 10/1988 | Olson et al. . |
| 5,131,312 | 7/1992 | Macor . |
| 5,582,083 | 12/1996 | Baker . |
| 5,953,968 | 9/1999 | Macor . |

*Primary Examiner*—D. S. Meislin

(57) ABSTRACT

An open end wrench head is described for use with a fastener having at least two substantially parallel outer engaging surfaces creating an across-width dimension. The open end wrench head has an orifice which includes four principle internal engaging surfaces which are arranged about an imaginary central axis with the first and second internal engaging surfaces positioned on a first jaw and the third and fourth internal engaging surfaces positioned on a second opposing jaw. The first internal engaging surface is substantially flat and substantially parallel to the imaginary central axis and positioned closer to the open end of the wrench head than the second internal engaging surface. The second internal engaging surface diverges outward from the first internal engaging surface. The third internal engaging surface asymmetrically opposes the second internal engaging surface and is substantially flat and substantially parallel to the imaginary central axis and positioned farther away from the open end of the wrench head than the fourth internal engaging surface. The fourth internal engaging surface asymmetrically opposes the first internal engaging surface and diverges outward from the third internal engaging surface. The second and fourth internal engaging surfaces are spaced apart by a dimension slightly less than the across-width dimension of the fastener thereby providing for a pinch-locking effect to the fastener under torque.

14 Claims, 4 Drawing Sheets

FIG. 2

FIG. 3
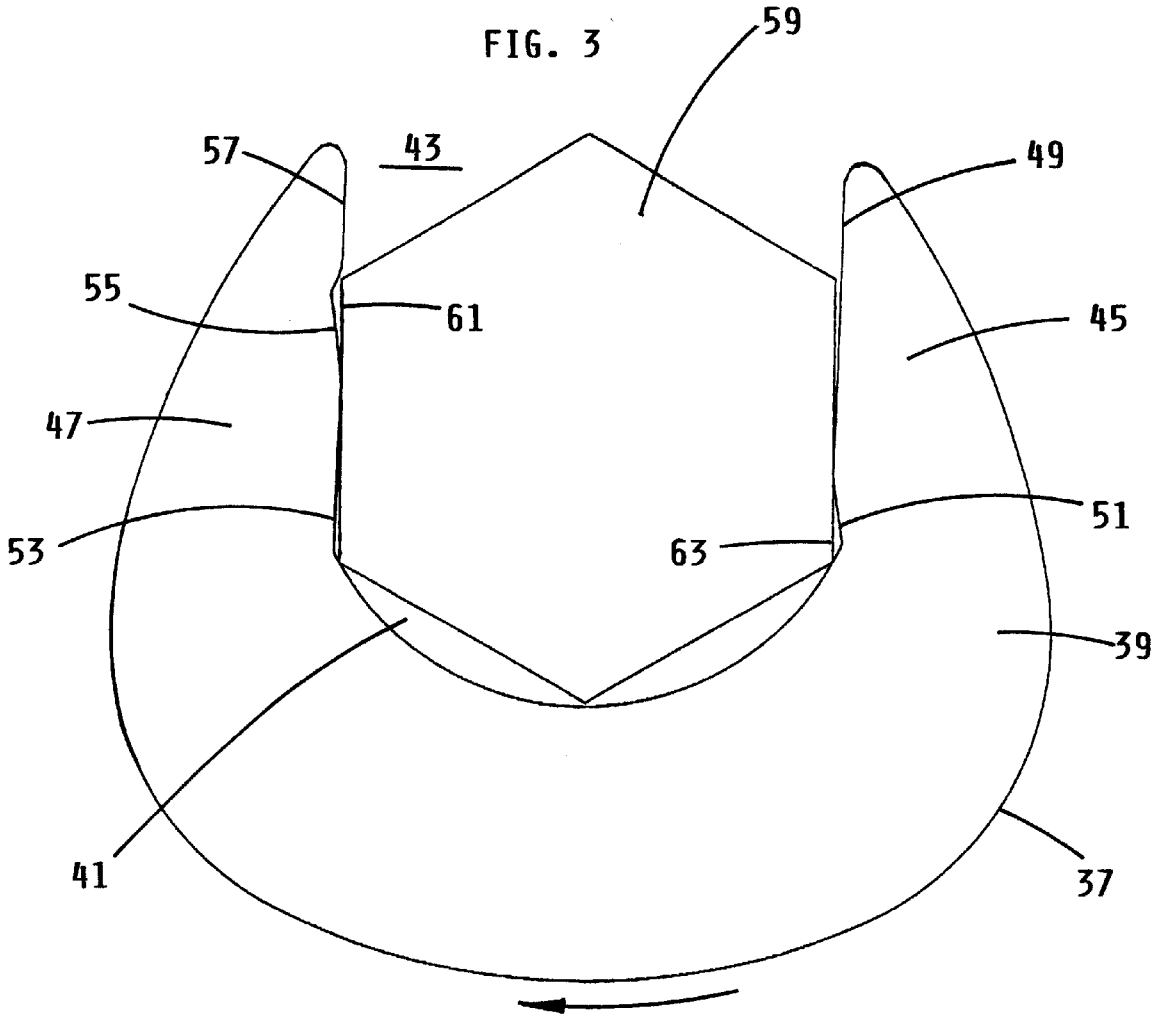
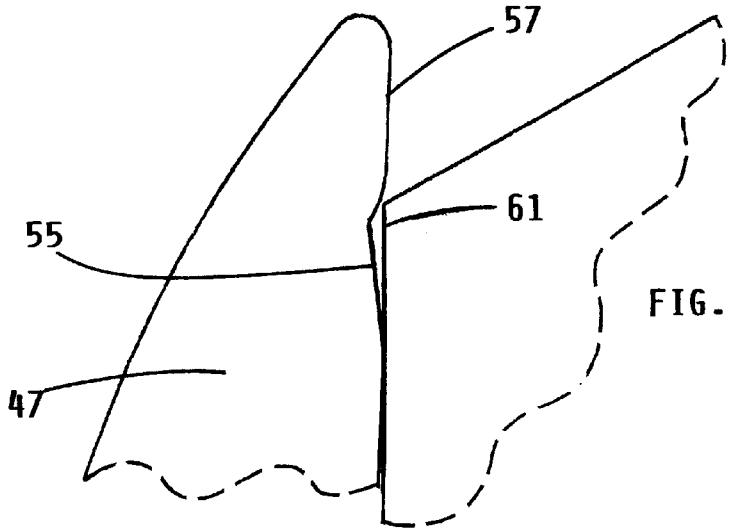
FIG. 4

FIG. 5
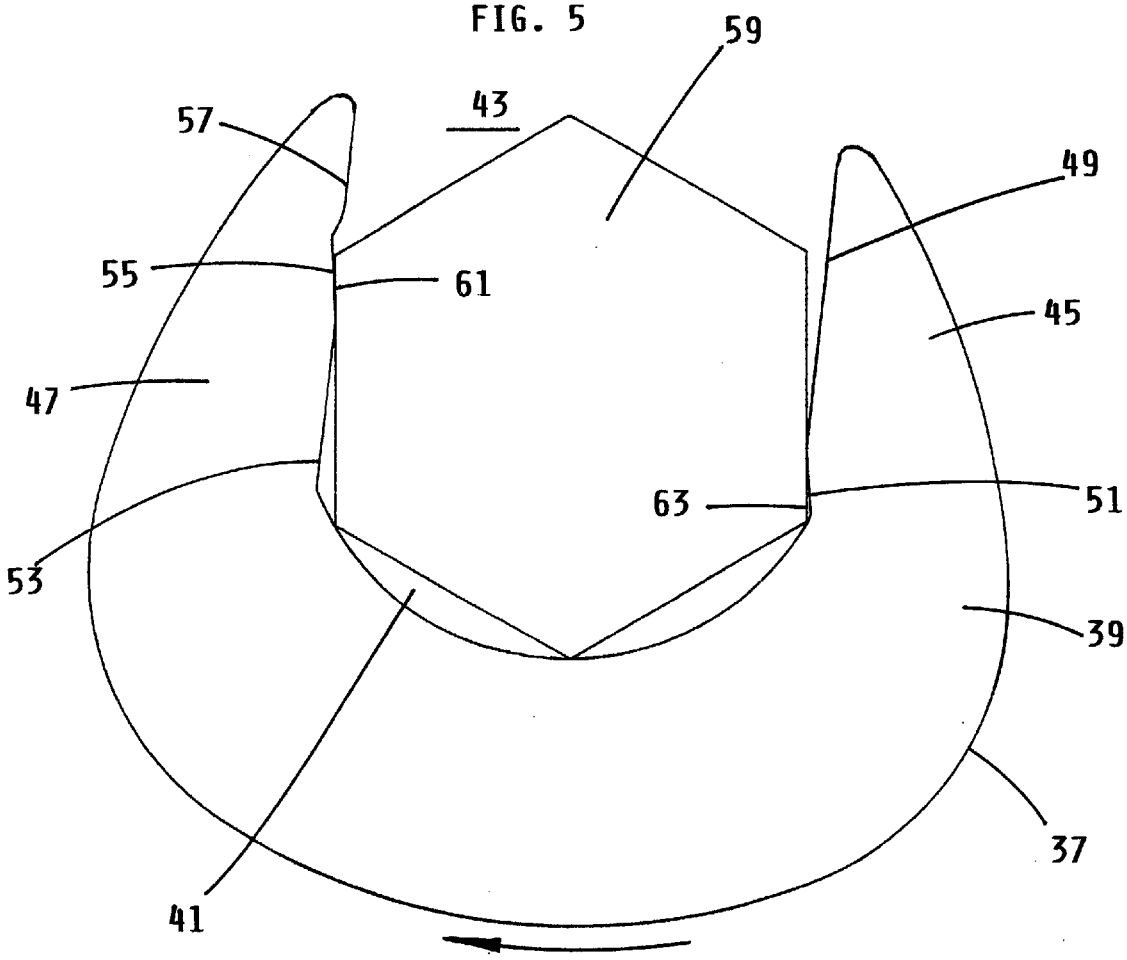
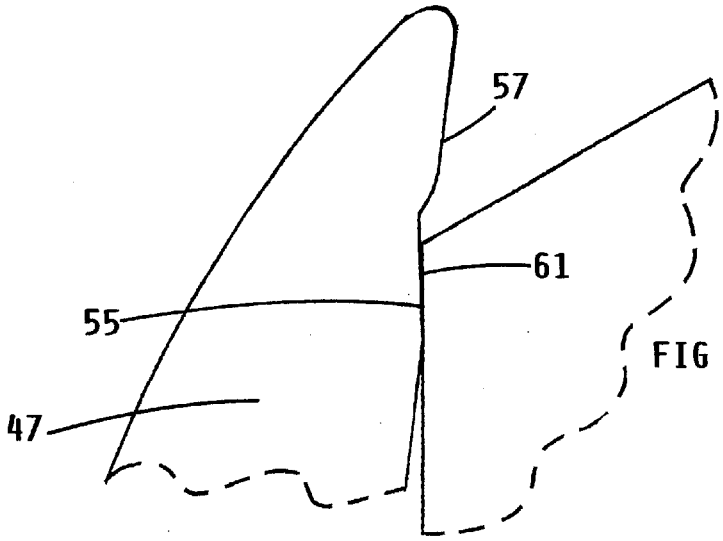
FIG 6.

WRENCH WITH PINCH-LOCKING ENGAGING SURFACES

REFERENCES TO RELATED APPLICATIONS

This application is a continuation-in-part of U.S. patent application Ser. No. 09/208,372 filed on Dec. 9, 1998, by the inventor herein, now U.S. Pat. No. 6,082,228 entitled UNIDIRECTIONAL OPEN END WRENCH.

FIELD OF THE INVENTION

The present invention relates to hand tools, particularly wrenches and most particularly open end type wrenches.

BACKGROUND OF THE INVENTION

An open end wrench is a wrench that has an open ended wrench head used to turn and control the rotation of bolts, nuts and various fasteners. Examples of open end wrenches include, but are not limited to, double open end, combination, flare nut, flex head etc. An open end wrench can access fasteners under certain limited-access conditions where a closed end or box wrench cannot, however, an open end wrench is much weaker by design than a box wrench. The weakness is associated with the inevitable jaw spread produced by the cam effect of fastener to wrench, under torque. This inherent weakness reduces torque capacity and promotes fastener deformation and wrench wear.

Subsequently, there have been numerous attempts to increase the strength and torque capacity of open end wrenches. The use of sharp teeth or serrations has been relatively effective on all but extremely hard fasteners, however, this technology sacrificed the fastener to gain additional torque by leaving bite or shred marks on the fastener. The use of inclined and arcuate driving surfaces has been effective at reducing the bite marks and fastener deformation, however, this technology has been generally less effective at increasing wrench strength and torque capacity. In addition, most prior attempts to improve the torque capacity of open end wrenches have consequently produced an increase in the total free play arc between wrench and fastener which applicant believes to be objectionable to most users.

SUMMARY OF THE INVENTION

The present invention involves a unidirectional, high torque, open end wrench head which when turned in a predetermined direction can provide a substantial increase in torque capacity while reducing fastener deformation and wrench wear.

The present invention more specifically involves a one piece, open end wrench head for a fastener having at least two substantially parallel outer engaging surfaces creating an across-width dimension. The open end wrench head has an orifice which includes four principle internal engaging surfaces which are arranged about an imaginary central axis with the first and second internal engaging surfaces positioned on a first jaw and the third and fourth internal engaging surfaces positioned on a second opposing jaw. The first internal engaging surface is substantially flat and substantially parallel to the imaginary central axis and positioned closer to the open end of the wrench head than the second internal engaging surface. The second internal engaging surface diverges outward from the first internal engaging surface. The third internal engaging surface asymmetrically opposes the second internal engaging surface and is substantially flat and substantially parallel to the imaginary central axis and positioned farther away from the open end of the wrench head than the fourth internal engaging surface. The fourth internal engaging surface asymmetrically opposes the first internal engaging surface and diverges outward from the third internal engaging surface. The second and fourth internal engaging surfaces are spaced apart by a dimension slightly less than the across-width dimension of the fastener which provides a pinching effect to the fastener under torque. In some preferred embodiments the second and fourth internal engaging surfaces are substantially flat, while in other preferred embodiments the second and fourth internal engaging surfaces are substantially arcuate.

The present invention has been developed recognizing the inevitable jaw spread of a standard open end wrench under torque and the subsequent need to increase wrench strength and torque while reducing fastener deformation and wrench wear. The present invention wrench, therefore, relies upon a predetermined amount of jaw spread to develop a "pinch locking" effect and substantial surface-to-surface engagement with a fastener during the torque process. In addition, the present invention has been developed recognizing the need to achieve such increases in performance without increasing the total free play arc between wrench and fastener or precluding wrench head offset ("flip-flop") capability.

Accordingly, it is an important objective of the present invention described above to significantly increase the strength and torque capacity of an open end wrench head without sacrificing the fastener by leaving bite marks, shred marks or otherwise deforming the fastener.

It is another objective of the present invention to achieve the improved performance without significantly increasing the total free play arc between wrench and fastener and while maintaining the ability to flip the wrench over or "flip-flop" the wrench in limited access situations.

It is another objective of the present invention that it be commercially viable, simple in design, and cost efficient to manufacture.

BRIEF DESCRIPTION OF THE DRAWINGS

FIG. 3 shows a top plan view of another present invention wrench head turning clockwise on a hexagonal fastener also shown in a top plan view, without the application of torque;

FIG. 4 shows an enlargement of the upper left portion of the wrench head and fastener shown in FIG. 3;

FIG. 5 shows the present invention wrench head shown in FIGS. 3 and 4 with the wrench head also turning clockwise on the hexagonal fastener, but with the application of torque and subsequent jaw spread; and, FIG. 6 shows an enlargement of the upper left portion of the wrench and fastener shown in FIG. 5;

DETAILED DESCRIPTION OF THE DRAWINGS

Figure 1:
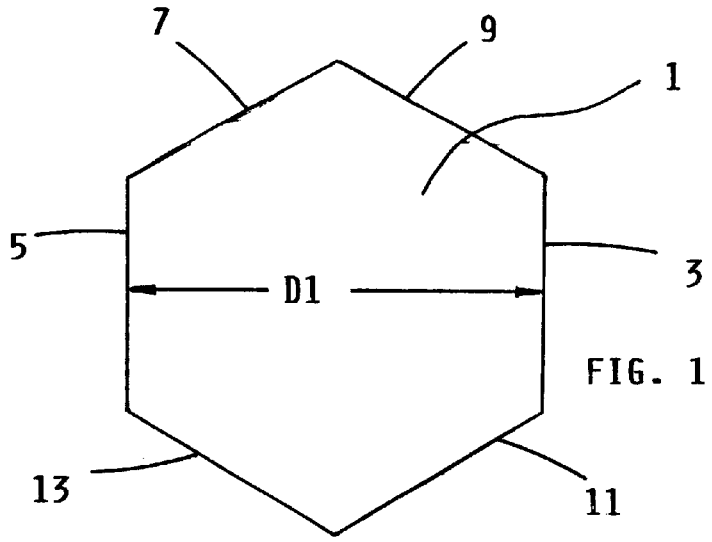
FIG. 1 shows a top plan view of a hexagonal fastener which has at least two, substantially parallel outer engaging surfaces.

Referring now to the drawings which are for the purpose of illustrating preferred embodiments of the present invention and not for the purpose of limiting same, FIG. 1 shows a hexagonal fastener 1 having six relatively flat outer engaging surfaces 3,5,7,9,11 and 13. Opposing surfaces are substantially parallel to each other, for example outer engaging surfaces 3 and 5 are substantially parallel each other and create an across-width dimension D1. The across-width dimension represents the actual size of the fastener and not necessarily the nominal size of the fastener, and this dimension is relational to positioning and spacing of the principle internal engaging surfaces of the present invention wrench head shown in FIG. 2.

Figure 2:
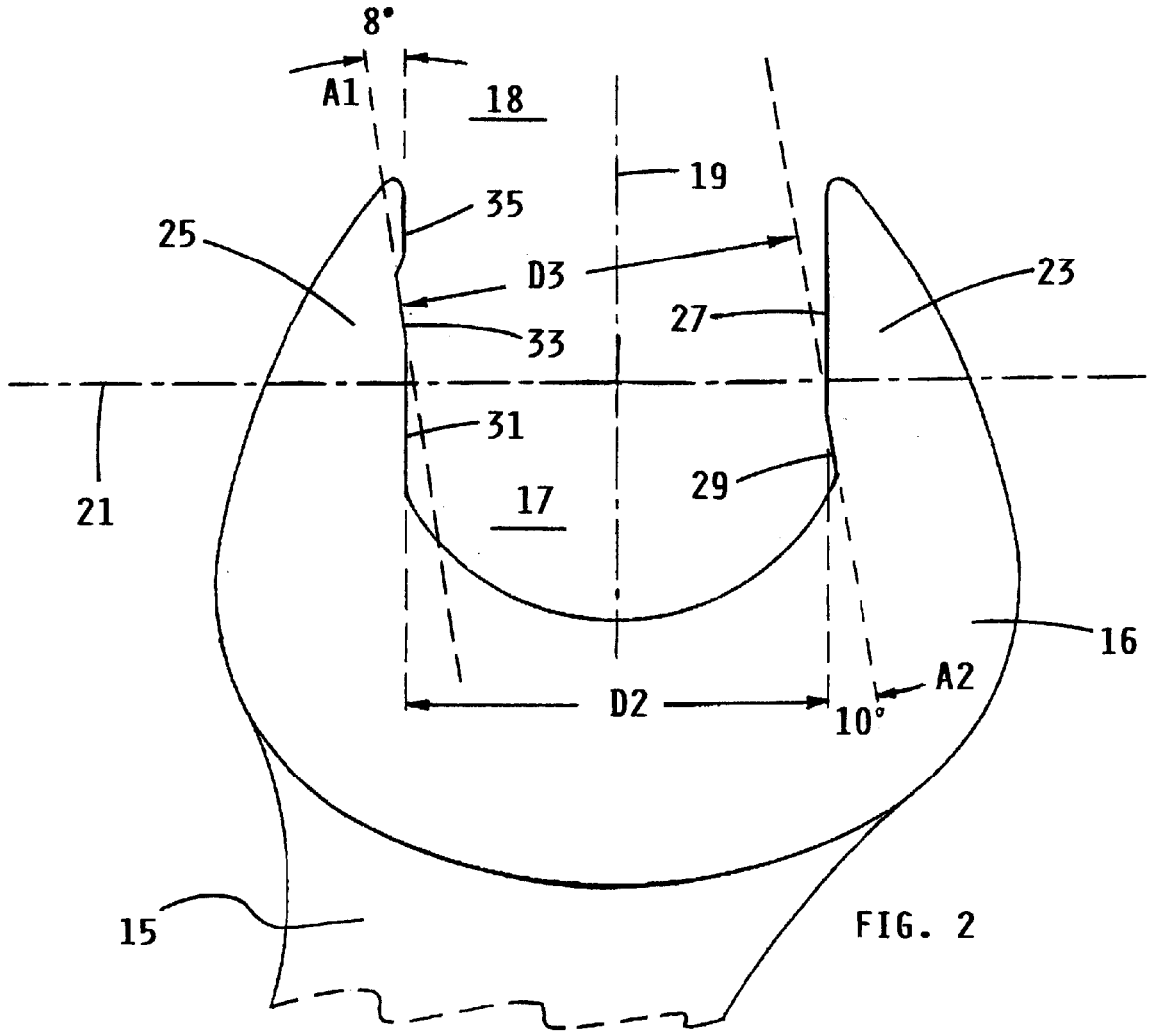
FIG. 2 shows a top plan, cut view of a wrench having a present invention wrench head for use with the hexagonal fastener shown in FIG. 1.

FIG. 2 shows a top plan, cut view of a wrench 15 with a present invention wrench head 16. Wrench head 16 is a one piece wrench head without any moving parts. Wrench head 16 includes orifice 17, open end 18 and four principle, internal engaging surfaces arranged asymmetrically around an imaginary central axis 19 and perpendicular cross-line 21. Imaginary central axis or center line 19 and perpendicular cross-line 21 together form four imaginary quadrants. The "principle" internal engaging surfaces are the internal engaging surfaces of the wrench head which are of the greatest importance and which actually engage and interact with the fastener under torque, during normal operation. The present invention includes four principle internal engaging surfaces and, therefore, could have more than, but not less than four. A first jaw 23 has the first internal engaging surface 27 and the second internal engaging surface 29. The first internal engaging surface 27 is substantially flat and parallel to imaginary central axis 19 and positioned closer to the open end 18 of wrench head 16 than the second internal engaging surface 29. The second internal engaging surface 29 diverges outward from the first internal engaging surface 27 and imaginary central axis 19 at an angle A2 which is about 10 degrees. In preferred embodiments of the present invention, the second internal engaging surface 29 diverges outward from the first internal engaging surface 27 (or imaginary central axis 19) at an angle within the range of 3 through 18 degrees. The angle could be slightly more or less but is preferably within that range. In more preferred embodiments of the present invention, the second internal engaging surface 29 diverges outward from the first internal engaging surface 27 (or imaginary central axis 19) at an angle within the range of 3 through 15 degrees. The second internal engaging surface 29 can be flat as shown in this view, or slightly arcuate as later shown in FIG. 7. A second opposing jaw 25 has the third internal engaging surface 31 and the fourth internal engaging surface 33. The third internal engaging surface 31 asymmetrically opposes the second internal engaging surface 29 and is substantially flat and parallel to the imaginary central axis 19 and positioned farther away from the open end 18 of wrench head 16 than the fourth internal engaging surface 33. The fourth internal engaging surface 33 diverges outward from the third internal engaging surface 31 and imaginary central axis 19 at an angle A1 which is about 8 degrees. In preferred embodiments of the present invention, the fourth internal engaging surface 33 diverges outward from the third internal engaging surface 31 (or imaginary central axis 19) at an angle within the range of 3 through 18 degrees. The angle could be slightly more or less but is preferably within that range. In more preferred embodiments of the present invention, the fourth internal engaging surface 33 diverges outward from the third internal engaging surface 31 (or imaginary central axis 19) at an angle within the range of 3 through 15 degrees. The fourth internal engaging surface 33 can be flat as shown in this view, or slightly arcuate as later shown in FIG. 7.

In this embodiment of the present invention, wrench head 16 also has a fifth internal engaging surface 35 which provides the wrench head with fastener tip engagement when the wrench head cannot be positioned properly on the bolt head, nut or fastener. The fifth internal engaging surface 35 which is substantially parallel to the first internal engaging surface 27 can also provide a user with the ability to feel and confirm wrench size to fastener. It should be noted that the fifth internal engaging surface 35 is not considered a principle internal engaging surface as defined herein above, because the fifth internal engaging surface does not actually engage and interact with the fastener under torque, during normal operation.

The first internal engaging surface 27 is parallel to and spaced apart from the third internal engaging surface 31 by a dimension D2 which is slightly greater than the across-with dimension D1 of the corresponding fastener shown in FIG. 1. This allows wrench head 16 to slide onto and begin interaction with the intended fastener shown in FIG. 1. Driving surfaces 29 and 33, however, are spaced apart by a distance D3 which is intentionally less than the across-width dimension of the intended fastener. In fact, the intended fastener (1 shown in FIG. 1) can not parallel fit between driving surfaces 29 and 33 when wrench head 16 is at rest and not under torque. Accordingly, the first and third internal engaging surfaces are spaced apart by a predetermined dimension; and, the second and fourth internal engaging surfaces are spaced apart by a dimension significantly less than the predetermined dimension by which the first and third internal engaging surfaces are spaced apart.

The jaws of all open end wrenches will flex and spread during the torque process. During this inevitable jaw flex and spread, great pressures are exerted between the inner engaging surfaces of the wrench and the outer engaging surfaces of the fastener. Accordingly, it is advantageous to spread this great pressure over as large an area as possible to minimize fastener and wrench deformation, and maximize torque. It is this anticipated jaw flex and spread between wrench jaws 23 and 25 which will allow the intended fastener (1 shown in FIG. 1) to parallel fit between and fully engage with driving surfaces 29 and 33. Thus, driving surfaces 29 and 33 do not achieve a parallel relationship and substantial surface-to-surface engagement with the outer engaging surfaces of the intended fastener while at rest, however, driving surfaces 29 and 33 can and do achieve a parallel relationship or substantial surface-to-surface engagement with the outer engaging surfaces of the intended fastener during the torque process. In addition, engaging surfaces 29 and 33 actually provide a pinch-locking affect on the fastener, pinching the fastener between engaging surfaces 29 and 33. Again, engaging surfaces 29 and 33 are initially spaced apart less than the across-width dimension of the fastener but then conform to the exact across-width dimension of the fastener during the normal wrench flex and jaw spread created by torque.

Referring now to FIGS. 3 and 4, there is shown a wrench 37 with a present invention wrench head 39 having an orifice 41 and an open end 43. Wrench head 39 has four principle internal engaging surfaces 49, 51, 53 and 55 and is turning clockwise upon a fastener 59 without the application of torque and without jaw flex or spread. In these two FIGS. 3 and 4, it is clear to see that internal engaging surface 55 does not achieve a parallel relationship with corresponding fastener engaging surface 61. Likewise, it is clear to see that internal engaging surface 51 does not achieve a parallel relationship with corresponding fastener engaging surface 63. In fact, it is physically impossible for driving surfaces 51 and 55 to achieve a parallel and substantial surface-to-surface engagement with their corresponding fastener engaging surfaces 63 and 61 respectively, unless jaws 45 and 47 were spread apart.

FIGS. 5 and 6 show the same wrench head and fastener as shown in FIGS. 4 and 5 and are accordingly numbered the same, except for, in these two views an application of torque is being applied to wrench head 37 and the subsequent affects of jaw flex and spread can be seen. With jaws 45 and 47 slightly spread apart, driving surfaces 51 is now able to achieve a parallel relationship and substantial surface-to-surface engagement with fastener engaging surface 63. Likewise and simultaneously driving surfaces 55 is now able to achieve a parallel relationship and substantial surface-to-surface engagement with fastener engaging surface 61. Again, this type of substantial surface-to-surface engagement (while under torque) is very desirable because it distributes the great pressures between wrench and fastener over a larger area, increasing torque capacity while reducing fastener deformation and wrench wear. In this view, fastener 59 is actually being forced and squeezed between driving surfaces 51 and 55 thereby creating a pinch-locking effect and significantly increasing the performance of wrench head 37. It should be noted that this significant increase in performance is achieved only when the wrench head is turned in a clockwise direction as shown in this view. If the wrench head were to be turned in a counter-clockwise direction the performance would be similar to that of a standard open end wrench. If one wished to loosened fastener 59, wrench head 37 can be inverted thereby engaging driving surfaces 51 and 55 to loosen or turn a fastener in a counter-clockwise direction maintaining the above performance increases.

Figure 7:
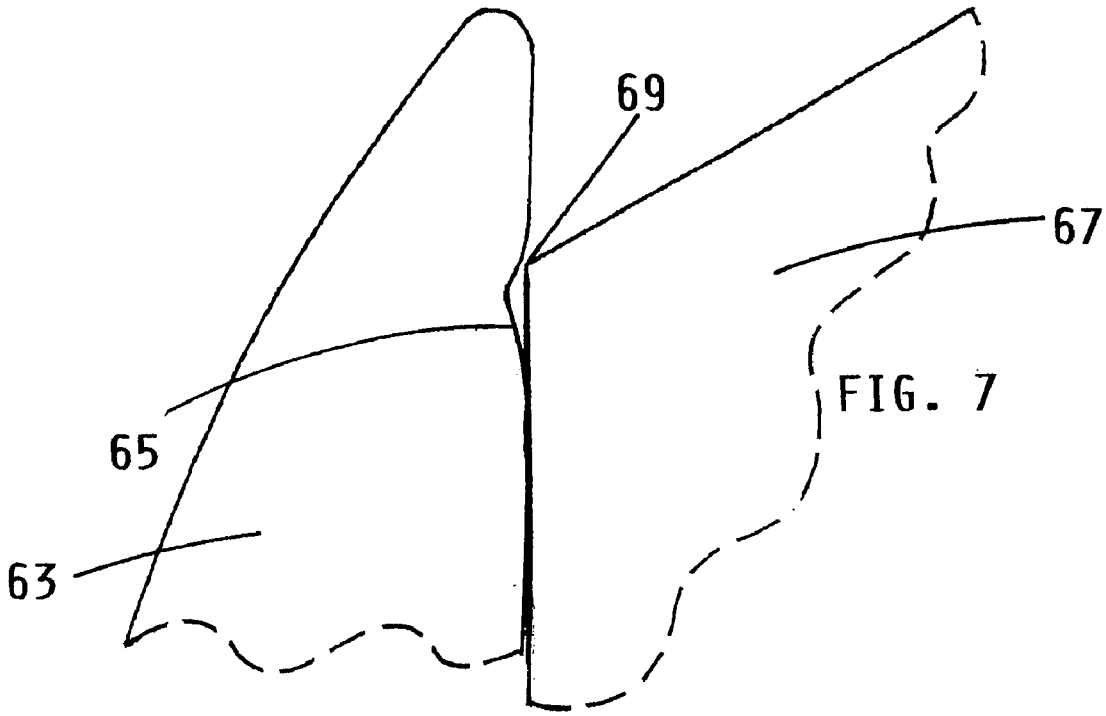
FIG. 7 shows an enlargement of the upper left portion of another present invention wrench head and fastener similar to that shown in FIG. 6.

FIG. 7 shows a close-up fragmentary portion of another present invention wrench without the application of torque and subsequent jaw flex and spread (similar to that shown in FIG. 4), but with the driving surface 65 of jaw 63 being substantially arcuate. Although arcuate driving surfaces are considered by this applicant to be less desirable than the flat driving surfaces shown in other views, this arrangement will tend to reduce fastener deformation and the rounding of point 69 of fastener 67.

Upon reading and understanding the specification of the present invention described above, modifications and alterations will become apparent to those skilled in the art. It is intended that all such modifications and alterations be included insofar as they come within the scope of the patent as claimed or the equivalence thereof.

Having thus described the invention, the following is claimed:

1. A one piece, open end wrench head for a fastener having at least two substantially parallel outer engaging surfaces creating an across-width dimension; said open end wrench head having an orifice comprising four principle internal engaging surfaces being arranged about an imaginary central axis with the first and second internal engaging surfaces being positioned on a first jaw and the third and fourth internal engaging surfaces being positioned on a second opposing jaw, said first internal engaging surface being substantially flat and substantially parallel to said imaginary central axis and positioned closer to the open end of said wrench head than said second internal engaging surface, said second internal engaging surface diverging outward from said first internal engaging surface, said third internal engaging surface being substantially flat and substantially parallel to said imaginary central axis and positioned asymmetrically opposing said second internal engaging surface and farther away from the open end of said wrench head than said fourth internal engaging surface, said fourth internal engaging surface asymmetrically opposing said first internal engaging surface and diverging outward from said third internal engaging surface, and, said first and third internal engaging surfaces being spaced apart by a predetermined dimension, said second and fourth internal engaging surfaces being spaced apart by a dimension less than the predetermined dimension by which said first and third internal engaging surfaces are spaced apart, thereby providing for a pinching effect to said fastener under torque.

2. A wrench head of claim 1, wherein said second and fourth internal engaging surfaces are substantially flat.

3. A wrench head of claim 1, wherein said second and fourth internal engaging surfaces are substantially arcuate.

4. A wrench head of claim 1, wherein there is a fifth internal engaging surface located on the second jaw of said wrench head, and said fifth internal engaging surface is substantially flat and substantially parallel to said imaginary central axis and positioned closer to the open end of said wrench head than said fourth internal engaging surface.

5. A wrench head of claim 2, wherein said second internal engaging surface diverges outward from said first internal engaging surface at an angle within the range of 3 through 15 degrees and said forth internal engaging surface diverges outward from said third internal engaging surface at an angle within the range of 3 through 15 degrees.

6. A wrench head of claim 2, wherein said second internal engaging surface diverges outward from said first internal engaging surface at an angle greater than the angle at which said fourth internal engaging surface diverges outward from said third internal engaging surface.

7. A wrench head of claim 3, wherein said second internal engaging surface is tangent to an imaginary line which diverges outward from said first internal engaging surface at an angle within the range of 3 through 15 degrees, and said forth internal engaging surface is tangent to an imaginary line which diverges outward from said third internal engaging surface at an angle within the range of 3 through 15 degrees.

8. A wrench head of claim 3, wherein said second internal engaging surface diverges outward tangent to an angle which is greater than an angle tangent to said fourth internal engaging surface.

9. A one piece, open end wrench head having an orifice with an imaginary central axis and an imaginary cross-line together forming four imaginary quadrants, said orifice comprising four principle internal engaging surfaces with the first and second internal engaging surfaces being positioned on a first jaw and the third and fourth internal engaging surfaces being positioned on a second opposing jaw, said first internal engaging surface being substantially flat and substantially parallel to said imaginary central axis and positioned closer to the open end of said wrench head than said second internal engaging surface, said second internal engaging surface being substantially arcuate and diverging outward from said first internal engaging surface, said third internal engaging surface being substantially flat and substantially parallel to said imaginary central axis and positioned asymmetrically opposing said second internal engaging surface and farther away from the open end of said wrench head than said fourth internal engaging surface, said fourth internal engaging surface being substantially arcuate and asymmetrically opposing said first internal engaging surface and diverging outward from said third internal engaging surface, and, said second and fourth internal engaging surfaces each being positioned within separate, diagonally opposed quadrants.

10. A wrench head of claim 9, wherein said second and fourth internal engaging surfaces are substantially arcuate.

11. A wrench head of claim 9, wherein there is a fifth internal engaging surface located on the second jaw of said wrench head, and said fifth internal engaging surface is substantially flat and substantially parallel to said imaginary central axis and positioned closer to the open end of said wrench head than said fourth internal engaging surface.

12. A wrench head of claim 10, wherein said second internal engaging surface is tangent to an imaginary line which diverges outward from said first internal engaging surface at an angle within the range of 3 through 15 degrees, and said forth internal engaging surface is tangent to an imaginary line which diverges outward from said third internal engaging surface at an angle within the range of 3 through 15 degrees.

13. A wrench head of claim 10, wherein said second internal engaging surface diverges outward tangent to an angle which is greater than an angle which is tangent to said fourth internal engaging surface.

14. A one piece, open end wrench head having an orifice comprising four principle internal engaging surfaces being arranged about an imaginary central axis with the first and second internal engaging surfaces being positioned on a first jaw and the third and fourth internal engaging surfaces being positioned on a second opposing jaw, said first internal engaging surface being substantially flat and substantially parallel to said imaginary central axis and positioned closer to the open end of said wrench head than said second internal engaging surface, said second internal engaging surface diverging outward relative to said first internal engaging surface, said third internal engaging surface being substantially flat and substantially parallel to said imaginary central axis and positioned asymmetrically opposing said second internal engaging surface and farther away from the open end of said wrench head than said fourth internal engaging surface, said fourth internal engaging surface asymmetrically opposing said first internal engaging surface and diverging outward relative to said third internal engaging surface, and, said first and third internal engaging surfaces being spaced apart by a predetermined dimension, said second and fourth internal engaging surfaces being spaced apart by a dimension less than the predetermined dimension by which said first and third internal engaging surfaces are spaced apart, thereby providing for a pinching effect to a fastener under torque.

* * * * *